United States Patent [19]

LeBlanc

[11] Patent Number: 4,979,916

[45] Date of Patent: Dec. 25, 1990

[54] CANOE PADDLE ASSEMBLY

[76] Inventor: Tom LeBlanc, 2966 St. Clair Avenue East, East York, Ontario, Canada, M4B 1P1

[21] Appl. No.: 411,872

[22] Filed: Sep. 25, 1989

[51] Int. Cl.[5] ..... B63H 16/20

[52] U.S. Cl. ..... 440/27; 114/347; 440/90

[58] Field of Search ..... 440/19, 21, 26–31, 440/90, 101; 114/347

[56] References Cited

U.S. PATENT DOCUMENTS

| | | | |
|---|---|---|---|
| 1,600,084 | 9/1926 | Adolph | 440/27 |
| 2,578,535 | 12/1951 | Graci | 440/27 |
| 4,271,548 | 6/1981 | Alberts | 440/113 |
| 4,511,338 | 4/1985 | Fanelli | 440/26 |

FOREIGN PATENT DOCUMENTS

| | | | |
|---|---|---|---|
| 585810 | 3/1925 | France | 440/27 |

*Primary Examiner*—Sherman Basinger

[57] ABSTRACT

The present invention provides a paddle assembly particularly designed for attachment to a canoe. The paddle assembly comprises a plurality of paddle members at opposite ends of the assembly, a central crank with sideways extending drive shafts to the paddle members, a pair of spaced apart gunwale clamps through which the drive shafts are rotatably fitted and an adjustable cinch strap between the gunwale clamps for wrapping beneath the canoe and cinching the gunwale clamps down onto the canoe to secure the paddle assembly in position.

12 Claims, 5 Drawing Sheets

FIG. 4.
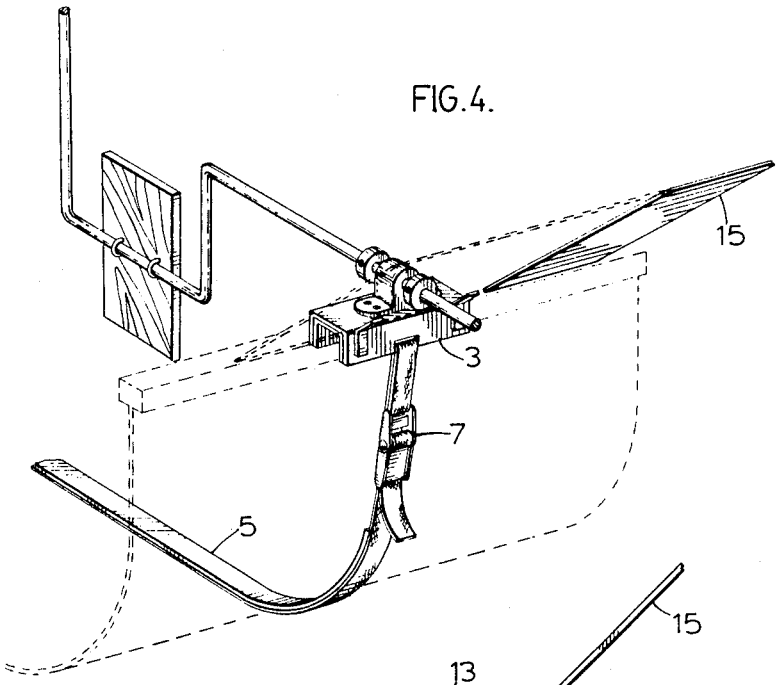
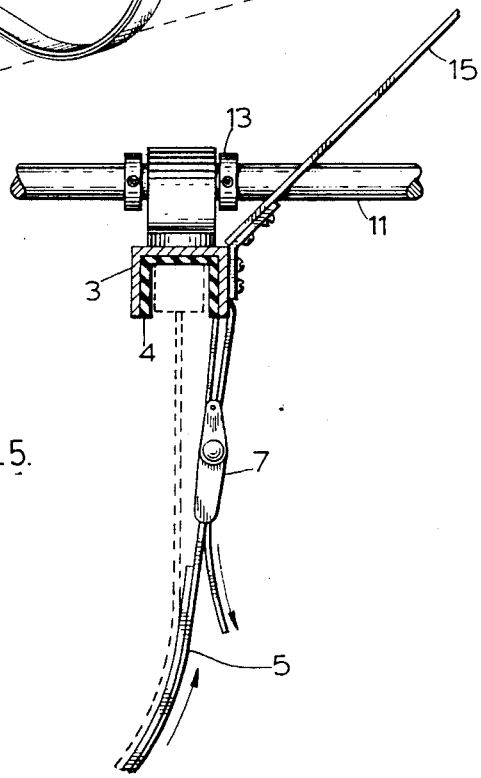
FIG. 5.

CANOE PADDLE ASSEMBLY

FIELD OF THE INVENTION

The present invention relates to a foot operated paddle assembly for attachment to a canoe.

BACKGROUND OF THE INVENTION

As most people who have been in canoes will appreciate, paddling is an extremely tiresome exercise if kept up for any significant length of time. It is particularly tiresome on the back, shoulders and arms which, for people who are in less than excellent physical shape, are relatively weak parts of the body.

In addition to being tiresome, canoe paddling requires a certain degree of skill particularly with respect to keeping the canoe on a straight path which necessitates alternate paddling to opposite sides of the canoe.

In light of the above, foot operated paddles have been designed for attachment to a canoe. These paddles are balanced on either side of the canoe and because of their foot operation are substantially less tiring than conventional paddling.

However, the paddle attachments that are presently available require relatively complicated attachment methods including physically bolting the paddles to the canoe. This is not desirable in that it leaves holes in the canoe. Furthermore, bolting and even standard clamping techniques do not provide the sturdiness required for an efficiently operated paddle attachment which is subject to significant operating stresses and pressures placed on it by the person paddling the canoe. If fact, in the case of a fibreglass canoe standard mounting methods create stresses which are likely to crack the fibreglass.

SUMMARY OF THE PRESENT INVENTION

The present invention provides a paddle assembly for attachment to a canoe and the like using a simple yet extremely efficient and strong mounting for the paddle assembly. More particularly, the paddle assembly for the present invention, which comprises paddle means at opposite ends thereof, a central crank and sideways extending drive shafts from the crank to the paddle means, is mounted by means of a pair of spaced apart gunwale clamps through which the drive shafts are rotatably fitted and an adjustable cinch strap between the gunwale clamps for wrapping beneath the canoe and cinching the gunwale clamps down onto the canoe to secure the paddle assembly very positively in position.

According to the mounting arrangement described immediately above no special hardware other than the cinch strap is required making the assembly extremely attractive from the standpoint that no modifications whatsoever are required to the canoe. From a strength standpoint, the tighter the cinch strap the more the clamps are pulled down onto the canoe with support across the paddle assembly being provided from both above and below the canoe.

BRIEF DESCRIPTION OF THE DRAWINGS

The above as well as other advantages and feature of the present invention will be described in greater detail according to the preferred embodiments of the present invention in which:

FIG. 4 is a perspective view of the cinch strap closure from the assembly of FIG. 3.

FIG. 5 is an end view of the arrangement shown in FIG. 4.

DETAILED DESCRIPTION ACCORDING TO THE PREFERRED EMBODIMENTS OF THE PRESENT INVENTION IN WHICH

Figure 1:
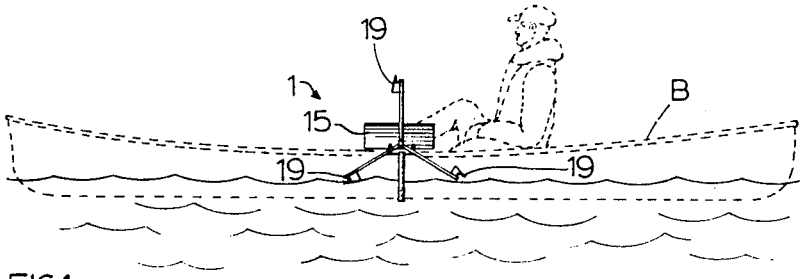
FIG. 1 shows a boat and its operator in phantom with the boat provided with a paddle assembly according to a preferred embodiment of the present invention.

FIG. 1 shows a boat B fitted with a paddle assembly generally indicated at 1. This particular figure does not show much in the way of detailing on the paddle assembly but does show the operator sitting upright and operating the paddle assembly with a strong leg motion.

Figure 3:
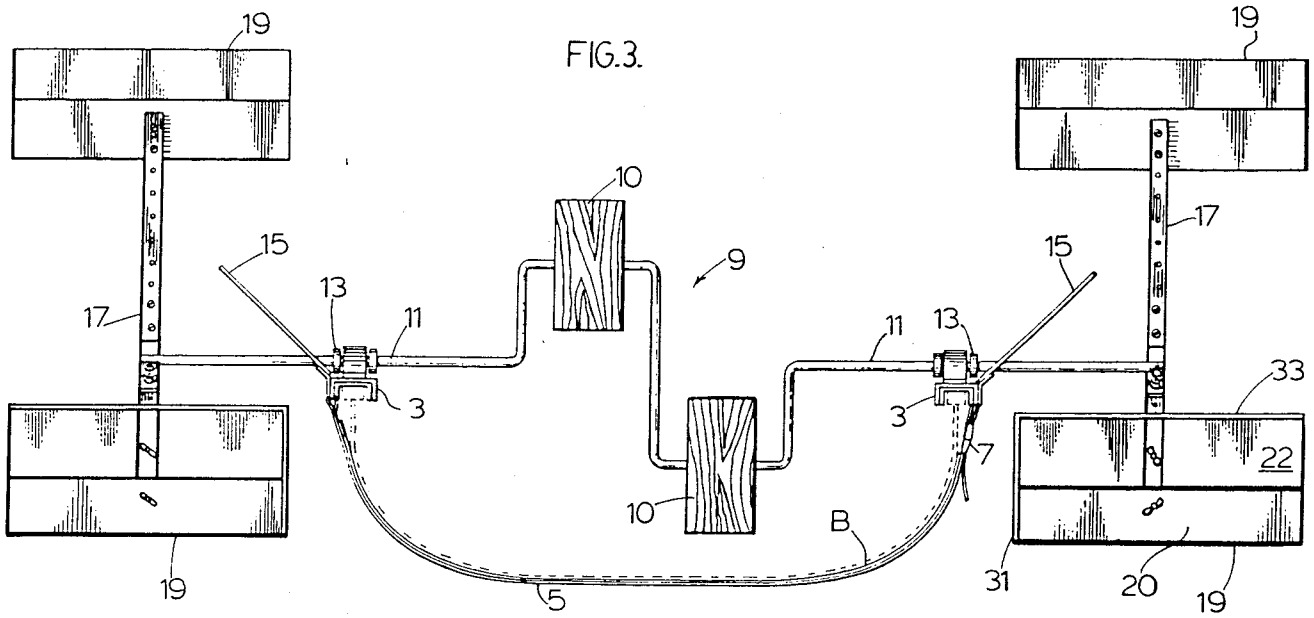
FIG. 3 is a rear end view of the paddle assembly as mounted to a boat, again shown in phantom.

The overall construction of the paddle assembly is best seen having reference to FIG. 3 of the drawings. In its entirety, the assembly comprises a pair of gunwale mounts or clamps 3 supported by a pair of drive shafts 11 rotatably fitted through the gunwale clamps and rotated by a foot operated crank generally indicated at 9 and including rotatably mounted foot pads 10.

Figure 2:
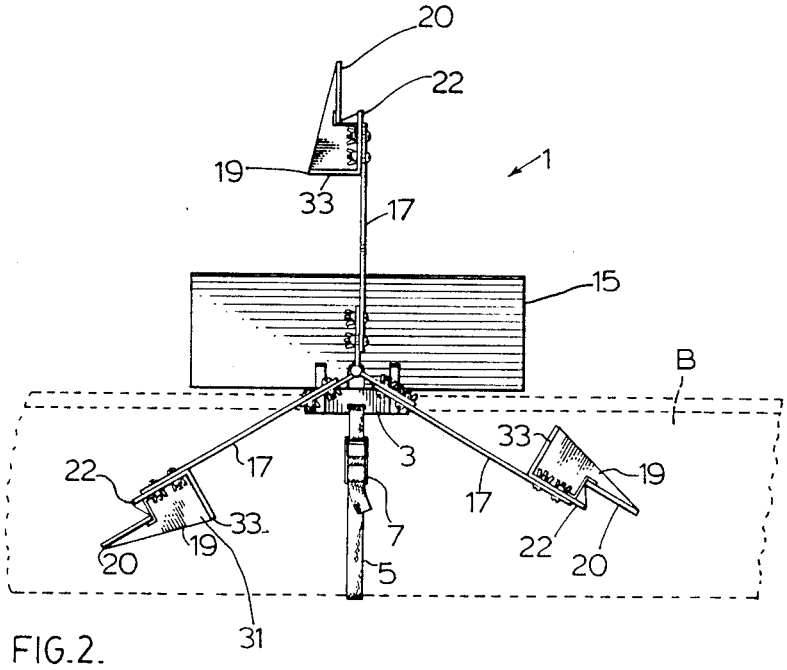
FIG. 2 is an enlarged side view of the paddle assembly from FIG. 1.

Each of the drive shafts 11 extends outwardly through bushings 13 of the gunwale clamps to paddle means at opposite sides of the canoe or boat B. Each of these paddle means comprises three individual paddle members 19. These paddle members are mounted to drive shafts 11 by arms 17 extending radially of the drive shafts. This particular construction is best seen in FIG. 2 of the drawings. The supporting arms of for the paddle members are located at obtuse angles relative to one another. With this arrangement, the paddles can be turned to the FIGS. 1 and 2 positions substantially out of the water allowing free floating of the canoe through shallow areas.

Returning to FIG. 3, the canoe assembly further includes splash guards 15 supported from the gunwale clamps extending upwardly outwardly toward the paddles. These splash guards can also be seen in FIGS. 2, 4 and 5 of the drawings.

Each of the paddles has a unique tiered construction and is is also provided with a combination splash/spill guard comprising an inside edge wall as well as a rear wall. Therefore, each of the paddles has a scoop or a shovel-like construction. This construction is designed in combination with splash guard 15 to prevent splashing inwardly along the paddle at the operator as the paddle first strikes the water. As a secondary feature, the shovel-like construction, including the inside edge and rear walls is designed to prevent spilling towards the operator as the paddle first leaves the water before the water is completely drained from the paddle.

Figure 6:
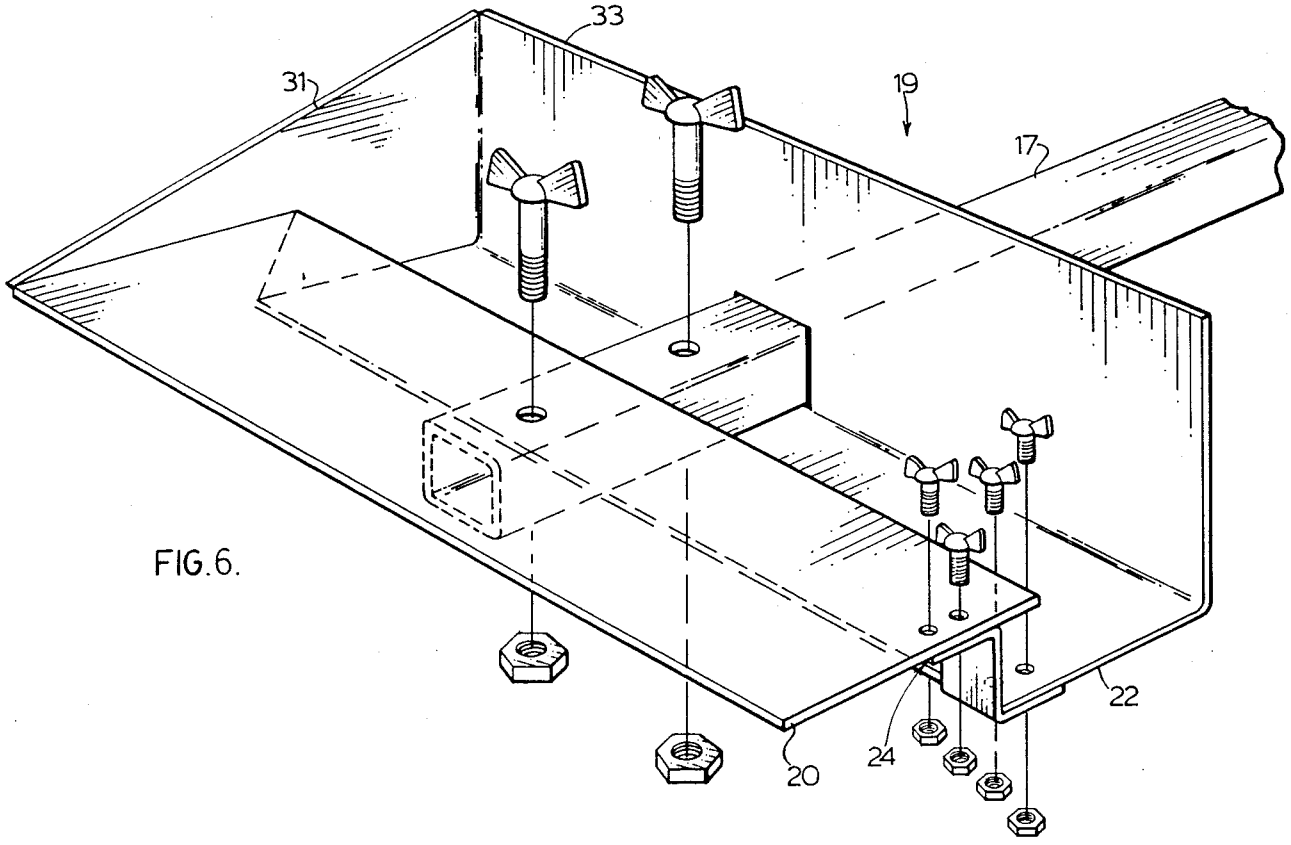
FIG. 6 is an enlarged perspective view of an actual paddle member from the assembly of FIG. 2 according to a preferred embodiment of the invention.

FIG. 6 shows paddle member 19 from the assembly of FIG. 2. This is a two tiered construction comprising paddle tiers 20 and 22. These tiers are separated by opening 24 running across the paddle. The combination splash/spill guard is provided by inside and rear walls 31 and 33. Note that the paddle could also include more than two tiers, i.e. three or more tiers.

The tiered construction of the paddles, whether it be two tiers or more, has been designed for maximum drainage efficiency. As each of the paddles leaves the water, the water runs off the individual shorter tiers separately rather than having to run off of one much longer paddle face. Therefore by shortening the faces, the water drains off much more quickly with very little tendency for the paddle to carry the water upwardly where, even in a mild cross wind, it might otherwise blow onto as a spray the operator of the boat.

In the description above, each of the individual paddle members is of a fixed or rigid tiered construction. This construction while being effective does present a certain amount of drag or resistance slowing its movement through the water.

Figure 7:
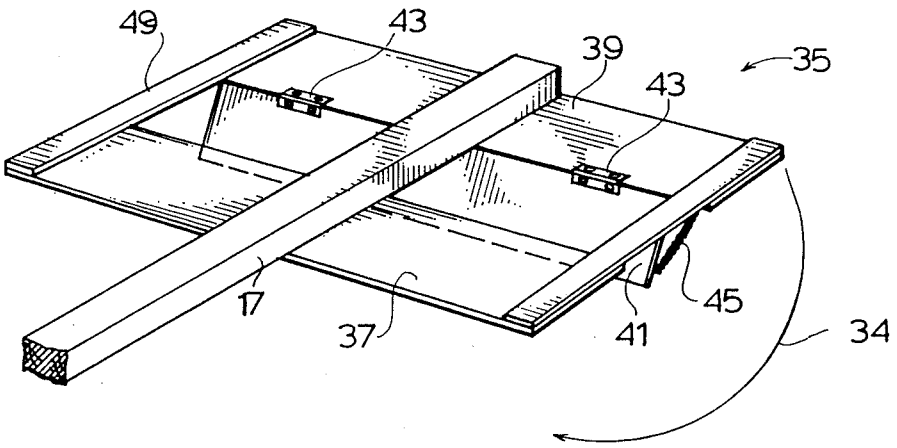
FIG. 7 is a perspective view of an alternate form of a paddle member according to a further preferred embodiment of the present invention.

More specifically, a paddle member generally indicated at 35 as shown in FIG. 7. This paddle member would be mounted to the same support arm 17 along with a series of other similar paddle members in the same manner as that described in the earlier embodiments to provide rotating paddle means, one at each side of the canoe paddle assembly. The direction of rotation of the paddle member on support arm 17 is indicated by arrow 34.

Paddle member 35 includes a first fixed paddle portion 37 and a second fixed paddle portion 39. In addition, paddle member 35 includes a movable paddle portion 41 mounted to fixed paddle portion 39 by hinges 43. Paddle portion 41 is normally maintained in its open position as shown in FIG. 7 by means of a spring 45. However, paddle portion 41 is closeable against the spring bias of spring 45 as the paddle moves down into the water to be described later in detail.

Provided around the outside edge of paddle member 35 is a slight brace or support member 49.

Paddle member 35 as can be seen from the drawings does not have anything in the way of a tiered construction and therefore provides a much cleaner or smoother surface for moving through and reducing its resistance in the water.

When the canoe paddle assembly is operated to rotate paddle member 35 in the direction of arrow 34, the paddle member approaches the water with paddle portion 41 in the open position. However, as the paddle member strikes the water, the water forces the movable paddle portion 41 to close thereby forming a solid paddle surface for maximizing its efficiency as it rotates through the water. However, as soon as the paddle member starts to emerge from the water after having completed a paddle cycle, paddle portion or flap 41 is pulled open by spring 45 to allow the drainage of any water that is on what would now be the up surface of the paddle member through the center opening in the paddle created by the opening of the paddle portion or flap 41. As was the case with the tiered construction, the water does not have to travel the full distance across the paddle surface draining very quickly rather than carrying the water up with the paddle where it might otherwise wet the paddle operator. In addition, paddle portion 41 when in its open position provides a splash guard and a guide for the water drained through the open region in the paddle.

The description above relates to a flap like pivotal paddle portion operated in one direction by a spring and in the other direction by water pressure. Other types of movable paddle portions can also be used. For example sliding paddle portions and multiple sliding paddle portions both with and without springs can be provided.

Any of the above movable paddle portions are designed to quickly clear the water by creating an opening in the paddle through which the water drains as the paddle rises from the water. Each movable paddle portion is closed by water pressure and may also be opened by the weight of the water or a spring control.

In order to mount the overall assembly to the boat, clamps 3 are simply fitted atop the gunwales with cinch strap 5, which extends between the two gunwale clamps wrapped beneath the boat and cinched in tightly at cinch buckle 7 best shown in FIGS. 4 and 5 of the drawings. Note that the interior surface of the gunwale clamps is provided with a protective, preferably rubber, liner 4 which helps to guard against any damage to the canoe and which also dampens and tightens the fitting of the gunwale clamps. The cinch strap as fitted through buckle 7 is then pulled down as tightly as needed to positively engage the gunwale clamps at the top of the boat.

As will be appreciated from the description immediately above and as to be seen from the drawings, the gunwale clamps are supported both across the top of the boat by the drive shaft extensions of the crank assembly and from below the boat by the cinch strap. This makes the overall mounting of the assembly positively secured against any movement during operation of the paddle assembly. Furthermore, all of this is accomplished without requiring any special tools or the like.

It is to be noted from FIG. 5 that the bushings 13 of the gunwale clamps have set screws which allow them to be moved on the drive shafts to any desired width setting according to the width of the boat itself. Therefore, not only is the paddle assembly extremely effective but it is additionally versatile for fitting to substantially any boat size.

The overall construction of the assembly with the exception of the cinch strap will be preferably made from high strength plastics not subject to water deterioration and light in weight so as not to inadversely affect the boats maneuverability in the water. This cinch strap is preferably made from a flexible plastic material to conform to the shape of the boat while once again being resistant to water deterioration.

Although various preferred embodiments of the invention have been described, it is to be appreciated that variations may be made without departing from the spirit of the invention or the scope of the appended claims.

The embodiments of the invention in which an exclusive property or privilege is claimed are defined as follows:

1. A paddle assembly for attachment to a canoe and the like, said paddle assembly comprising paddle means at opposite ends thereof, a central crank with sideways extending drive shafts to said paddle means, a pair of spaced apart gunwale clamps through which said drive shafts are rotatably fitted and an adjustable cinch strap between said gunwale clamps for wrapping beneath the canoe and cinching said gunwale clamps down onto the canoe to secure said paddle assembly in position, said paddle means comprising a plurality of individual paddle members supported by arms extending radially of each of said drive shafts, each paddle member having a scoop-like tiered construction with water release openings therein and a splash/spill guard against inwardly directed splash/spill from each paddle member.

2. A paddle assembly as claimed in claim 1, wherein said gunwale clamps comprise downwardly opening channel members clampable without further hardware other than said cinch strap to the canoe.

3. A paddle assembly as claimed in claim 2, wherein said gunwale clamps are interiorly lined with a cushioning material.

4. A paddle assembly as claimed in claim 1, wherein said gunwale clamps are bushing mounted on said drive shafts to allow rotation thereof with said gunwale clamps secured in position by said cinch strap.

5. A paddle assembly as claimed in claim 4, wherein said bushings and gunwale clamps are adjustable to different width settings on said drive shafts.

6. A paddle assembly as claimed in claim 1, wherein said splash/spill guard comprises an inside and rear edge wall on said paddle member.

7. A paddle assembly as claimed in claim 1, including a splash guard on each of said gunwale clamps.

8. A paddle assembly as claimed in claim 7, wherein said splash guard comprises a plate angled upwardly and outwardly from each of said gunwale clamps toward each of said paddle members.

9. A paddle assembly for attachment to a canoe and the like, said paddle assembly comprising paddle means at opposite ends thereof, a central crank with sideways extending drive shafts to said paddle means, a pair of spaced apart gunwale clamps through which said drive shafts are rotatably fitted and an adjustable cinch strap between said gunwale clamps for wrapping beneath the canoe and cinching said gunwale clamps down onto the canoe to secure said paddle assembly in position, said paddle means comprising a plurality of individual paddle members supported by arms extending radially of each of said drive shafts, each paddle member having a movable paddle portion providing an opening in said paddle member when in an open position and which is movable to a closed position by water pressure on said paddle member to present a solid paddle surface across said paddle member.

10. A paddle assembly as claimed in claim 9, including fixed paddle portions to opposite sides of said movable paddle portion, said movable paddle portion providing a water drain guide and a splash guard on said paddle member when in said open position.

11. A paddle assembly as claimed in claim 9, wherein said movable paddle portion is spring biased to move to an open position and is movable to the closed position by the water pressure.

12. A paddle assembly as claimed in claim 11, wherein said movable paddle portion is formed as a pivotal flap in said paddle member.

* * * * *